United States Patent [19]

Tuurna

[11] Patent Number: 4,530,300

[45] Date of Patent: Jul. 23, 1985

[54] SLED WITH A BOARD-SAILING RIG

[76] Inventor: Sami A. E. Tuurna, Steniuksentie 12 B 26, 00320 Helsinki 32, Finland

[21] Appl. No.: 443,332

[22] Filed: Nov. 22, 1982

[30] Foreign Application Priority Data

Dec. 10, 1981 [FI] Finland ..... 813977

[51] Int. Cl.[3] ..... B62B 15/00

[52] U.S. Cl. ..... 114/43; 114/39; 280/12 H; 280/22

[58] Field of Search ..... 441/79; 114/43, 39; 280/21 R, 22, 12 H, 12 AA, 21 A, 28; D12/8, 9, 11

[56] References Cited

U.S. PATENT DOCUMENTS

| | | | |
|---|---|---|---|
| 1,084,697 | 1/1914 | Foster | 280/22 |
| 3,807,749 | 4/1974 | Kunselman | 280/21 R |
| 4,405,139 | 9/1983 | Kawahard | 441/79 |

FOREIGN PATENT DOCUMENTS

| | | | |
|---|---|---|---|
| 2824997 | 12/1979 | Fed. Rep. of Germany | 280/12 H |
| 80036 | 4/1952 | Norway | 280/22 |
| 27386 | of 1908 | United Kingdom | 280/22 |

*Primary Examiner*—Sherman D. Basinger
*Assistant Examiner*—Thomas J. Brahan
*Attorney, Agent, or Firm*—Robert Shaw

[57] ABSTRACT

A windsurfing mechanism that comprises a plurality of gliding parts to permit travel at the surface of a medium and adapted to prevent the windsurfing mechanism from sinking into the body of the medium, said plurality of gliding parts being mechanically secured to one another to form an elongate but flexible structure having a surface to support a surfer. To provide propulsion of the mechanism along the surface of the medium a sail is secured to the ski like gliding parts. To the flexible structure is also secured a fin extending rearwardly from the flexible structure to engage said medium. The fin is vertically flexible and laterally bendable.

6 Claims, 4 Drawing Figures

SLED WITH A BOARD-SAILING RIG

The subject matter of the present invention is a sled with a board-sailing rig to be sailed in winter conditions. With this apparatus, sailing is possible in varied ice and snow conditions. As in surfing, the apparatus is steered with the feet, by moving the weight of the sailor and by changing the position of the rig.

Sleds with board-sailing rigs known so far (U.S. Pat. No. 3,487,800) have made a new way of sailing possible in winter conditions. The sleds are light in weight and thus in principle suitable to be sailed also on soft snow and ice fields, which is not possible with heavy icecrafts with fixed masts.

Sleds with board-sailing rigs known so far are provided either with directional or turning, stiff runners or with fairly stiff skis. The following can be considered as the basic solutions: the sled is provided with a stiff plate mounted on three or four feet to which the runners are fixed (cf. U.S. Pat. No. 4,094,262; DE No. 26 07 378 and SE No. 415 467). Some of the runners, or parts of them, are non-directional, but stiff (like DE No. 26 07 378 and No. 27 38 141). A sled defined by patent SE No. 45677 does not make use of a board-sailing rig, but is in principle an apparatus with a fixed mast like SE No. 364 009. In addition, it is steered sitting down with a separate fin adjusted by the hands and not standing up like sleds with board-sailing rigs. However, the conditions north of the 60th parallel are best met with a skisled known as the "skisurfer", which is usually provided with two sharp-edged skis (e.g. slalom skis) mounted at an angle. The benefits achieved include the light weight and simple structure of the sled. The skisled moves both on ice and in thin snow. Compared with all sleds with runners, the skisled has the advantage that, due to the flexibility of the skis, the sled can move reasonably well also on uneven and varied surfaces (on ice and in the snow), which is not possible for sleds with runners. An example of too heavy solutions (approximately in excess of 35 kg) for varied ice and snow conditions is that used in SE No. 415 467.

So far in all the sailing sleds known, including those with skis, the principle of an inflexible frame has been applied. U.S. Pat. No. 3,479,980 is not meant to be sailed with a rig corresponding to U.S. Pat. No. 3,487,800 nor does it state that a flexible frame structure would be needed in order to prevent veering, even though the claims of that patent do contain a flexible frame meant to decrease the effects of an uneven underlying surface with the help of straps.

The disadvantages evident in sleds based on the principles of surfing have included the following: sleds provided with runners cannot be used for sailing in the snow, whereas sleds with skis have not had an adequate steerability on ice. Because the angle of the skis has to be steeper on ice, which in turn prevents the skis from bending, inflexible and often longish skis do not allow the sailor to make a safe turn at will. On clear ice this manifests itself so that as the speed accelerates and the so-called relative wind hits the sail at a smaller and smaller angle, the skisled tends to turn sideways across the direction of motion. This interference with steerability constitutes a safety hazard. A further problem is caused by the curvature of the skis, which causes understeering and, with regard to keeping the direction, instability typical of skisleds. In the skisleds with a board-sailing rig known so far the aim has been to build them very light in weight. The skis are fitted with support irons to the base plate, which is at an altitude of 10 to 40 cm from the surface of the ice. In spite of its light weight, a sled like this does not move in the deep snow, because the base plate gets stuck in snow barriers and the two skis cannot keep the sled from sinking into soft snow.

The principle applied in sleds with a windsurfing rig and three skis or runners has been to fit one inflexible turning runner or ski in the front of the sled (like in patent DE No. 27 38 141 above) in order to make turning possible. However, this makes the windward sailing properties of the sled worse than those of the so-called "skisurfer" sled, because the (often quite short) turning ski or runner gives way too much in soft snow or on ice. From this point of view the solution arrived at in patent DE No. 26 12 984 with an unturning front runner has also commercially proved to be more successful (the sled is known as the "Ice Bird"). As stated above, sleds with runners are not suited to northern conditions. This therefore also applies to patent U.S. Pat. No. 4,061,100, which, in addition, is based on a sailing boat and not a board-sailing rig, being converted, with the help of a sled, so that it can be sailed in winter conditions, like e.g. SE No. 364 009. Solutions used in patents DE No. 26 07 378 and SE No. 415 467, in which the rear runner can be made turnable and which have a total of four runners, are unsatisfactory even for the fact that the friction caused by the runners is too great for effective sailing and that the rear runner does not prevent the sled from sinking into snow or snowy ice due to the shortness and inadequate mounting of the rear runner in these sleds. A sled defined by patent SE No. 67834 with three runners is not meant to be sailed with a board-sailing rig, nor is the turning rear runner fitted to the rest of the frame in a flexible way. It must also be noted that solution SE No. 67834 cannot be sailed in snow. The apparatus defined by application PCT SE No. 8000281 is not a sled. The principle differs from that of a sled with a board-sailing rig in that the sail is tied to the sailor with straps and that the changing direction is not possible by same method as that used with a surfboard. The apparatus PCT SE No. 8000281 must also be considered to be dangerous for the sailor, because his feet are tied to the mechanism holding the sail up. In addition, the position of the sailor on this apparatus is unnatural, dangerous and strenuous. The apparatus defined by PCT SE No. 8000281 cannot be sailed in the snow either, because the two slalom skis fitted to it do not give enough support for the sailor.

The sled being introduced here brings a considerable improvement to the points described above. In order to achieve this, the board-sailing mechanism according to the invention comprises a plurality of gliding parts to permit travel at the surface of a medium and adapted to prevent the board-sailing mechanism from sinking into the boyd of the medium, said plurality of gliding parts being mechanically secured to one another to form an elongate but flexible structure having a surface to support a surfer;

sail means secured to the gliding parts to provide propulsion of the mechanism along the surface of the medium, and fin means secured to the flexible structure and extending longitudinally rearwardly from the flexible structure to engage said medium, the fin means being flexible in a direction that has a component orthogonal to the surface of the flexible structure.

The most important feature of this invention is the considerable improvement in the steerability and safety of the sled when compared with sleds with board-sailing rigs known so far. In an apparatus corresponding to the present invention, no regulation devices with a direct effect on the steering need be moved with the feet or with the hands during the sailing; instead the sailing takes place according to the principle applied in board-sailing. The absence of such regulating devices makes the apparatus easier to construct, lighter (the sled can be constructed to weigh under 15 kg) and it adds to the durability of the apparatus. The safety of the apparatus is increased by the possibility to fit it with separate floats without detriment to its other properties.

The invention is described in detail in the following figures, in which

Figure 1:
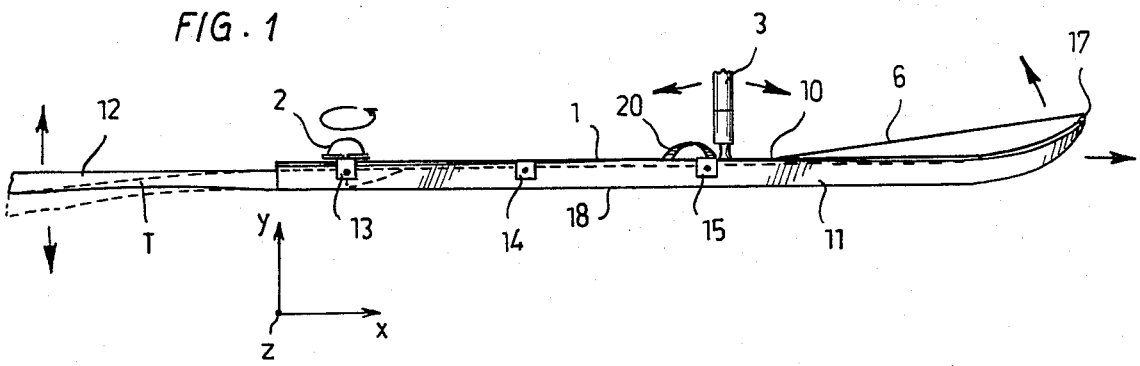
FIG. 1 shows the sled in side profile.

In FIG. 1 the base plate, on the upper surface of the sled, 1, is formed mainly by the area between the rotatable footstrap 2 and the jointfitted foot of the mast 3 corresponding to patent U.S. Pat. No. 3,487,800. From the foot of the mast 3 onwards the upper surface is formed by the straps 4, 5, 6 adjusting the curvature of the skis (in FIG. 1 only the outermost strap 6 can be seen) and the upper surface of the skis 7, 8, 9, 10, 11 (in FIG. 1 only the outermost ski 11 and part of ski 10 can be seen). The number of skis is not limited to five and for example the skis 8, 9 and 10 may be replaced with only one, maybe somewhat broader ski. The fin 12 is fitted so that it is vertically flexible as shown by the arrows. In FIG. 1 the fin 12 has been ground in the direction of its longitudinal axis so that it is slightly arched and sharpened on the underside in order to improve its grip on the ice. The grinding of the fin making it arched or rising towards its front starts in FIG. 1 in the area marked with the letter T. The fin can be ground or fitted so that all or part of it cuts into the ice. To some extent, the front of the fin 12 continues behind ski 9. This has been marked with the dotted line curving upwards and to the right and starting below the footstrap 2. The fin 12 thus ends before the arc 14. Between the outermost skis, of which only 11 can be seen in FIG. 1, and mounted to the front of these skis, is the means 16, 17 for adjusting the toe in; of these only one, 17, can be seen in FIG. 1. The arcs 13, 14 and 15 are flexible. The number of these flexible arcs is not restricted to three and they have been made of spring steel or other flexible material. The arcs 13, 14, 15 hold the sled together and a nonslippery support plate can be mounted on the arcs. Because of the arcs 13, 14, 15 the whole sled is flexible. This flexibility is partly enchanced by all the skis 7, 8, 9, 10, 11 used, whose flexibility is greatest in the section in front of arc 15. The ski 9 can be flexibly fitted to the arcs 13, 14, 15. Thus an adequate grip on the underlying surface (not shown in the figures) is attained, which, especially on hard ice, is necessary for the steering. In the snow the flexibility reduces the friction. The outermost skis 7 and 11, of which only 11 is seen in FIG. 1, are sharpened in the edges touching the ice. In FIG. 1 the sharpened edge of ski 11 touching the ice has been marked with the reference numer 18. In the sled in FIG. 1 the ice is touched by edge 18 of the ski 11 for all of its length as well as by the corresponding edge of the fin 12 in the rear of the sled. Whn the surface of the ice or the snow is uneven, only part of the subsurface of the sled may touch the underlying surface. In order to achieve good steerability on varied surfaces it is important that as long a section as possible of the subsurface of the sled will find support in the underlying surface. In order to maintain this property, the skis 7, 8, 9, 10, 11 are fitted so that they are as flexible as possible and the flexible fin 12 is mounted so that it is vertically flexible (in FIG. 1 in the directions indicated by the arrows) and can, to some extent, rotate around its own vertical axis. In this respect the mounting of the fin differs from the principle applied in SE No. 415 467. This can be exemplified as follows: If we imagine a "mound" under the sled in the area under arc 13, the subsurface of the front part of the ski 11 would be further down than the subsurface underneath arc 13, and correspondingly the rear tip of the fin 12 would be lower down than the front of the fin 12 under arc 13 and lower down than the subsurface of the ski 11. This position of the fin 12 is shown by the dotted line in FIG. 1.

The footstrap 2 is for the rear foot of the sailor. Footstrap 2 is rotatable around its vertical axis (not shown in the figures). In order for the rear foot of the sailor to hit the rear strap when he is sailing, the strap is only partly rotatable. It does thus not necessarily rotate a full 360 degrees around its vertical axis. This is important also from the point of view of safety. The corresponding footstraps 19 and 20 for the sailor's front foot are placed near the foot of the mast 3. The number of footstraps is not, however, limited to three and the footstraps 19 and 20 may be replaced by only one rotatable footstrap like the footstrap 2. The straps can be fitted with return springs. In FIG. 1 only footstrap 20 can be seen. The exact position of the footstraps on the upper surface of the sled depends on the size of the sailor and on the position of the other parts of the sled. The footstraps 2, 19, 20 are an essential and necessary part of the structure of the sled. Without them the steering of the sled in a hard wind and in loose snow is not possible.

Figure 2:
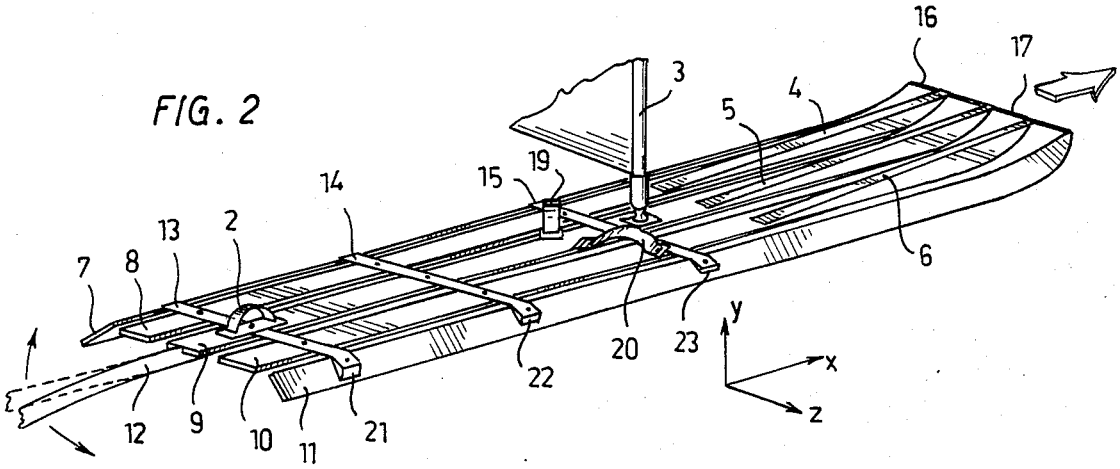
FIG. 2 shows the sled of FIG. 1 obliquely from behind and above.

In addition to the above parts FIG. 2 shows the means 21, 22 and 23 for adjusting the angle of the skis 7 and 11, as seen from the side of the ski 11. Although the skis 7 and 11 in FIG. 2 have been tilted so that their outer edges touch the ice, they can also be fitted so that their inner edges touch the underlying surface. Corresponding adjustment means are also fitted to the ski 7 (not shown in FIG. 2). When these parts 21, 22, 23 the angle of the skis to the underlying surface can be adjusted to suit different weather conditions also so that the skis are twisted with respect to their own longitudinal axis. This is possible only in a sled according to the present invention, in which steerability is thereby improved because the fin 12 makes sure the sled will keep its direction and that the front of the sled will not turn sideways against the direction of movement like the "skisurfer" sled, which will become oversteering if said measure is undertaken. In FIG. 2 the fin 12 is shown in two positions. In the position drawn by the dotted line the fin is in its rest position. The fin drawn by the continuous line shows the fin slightly bent to the right horizontally due to an imagined turn. FIG. 1 shows how the fitting of the fin 12 allows it to turn vertically without the fin curving vertically with respect to its vertical axis. Thus the whole of the fin 12 turns vertically from its point of fitting at the rear of the ski 9 as shown in FIG. 1. This can be achieved by making the fin 12 of spring steel or other material with similar properties. (In FIG. 2 the rear part of the fin 12 is not shown). Thus the fin 12 functions as the third turning support point with respect to the underlying surface, while the skis 7 and 11 form the other two support points needed. These positions of the gliding parts hav a crucial importance with regard to steerability and gliding ability. It should also be mentioned that the ski 9 need not necessarily be at the same altitude from the underlying surface as that shown in the figures.

When sailing, the sailor stands on the sailing base, formed on the upper surface of sled mainly in the area between the arcs 13 and 15 in FIG. 2. The structure of the sled due to the wide spacing of the skis decreases the amount of snow gathering on the upper surface of the sled. As the need may be, the sailor can use the footstraps 2 and 19 or 2 and 20, respectively, depending on which side of the sail he is standing (which direction he is sailing towards). As the curvature of all the skis 7, 8, 9, 10, 11 can be adjusted by means of the adjustment straps 4, 5, 6 in the front of the skis or by means of the adjustment means 16, 17 for the toe in (the figures do not show these straps fitted to the skis 7 and 11), the side profile of the sled can, when necessary, be made to resemble a "rocking chair". The profile of the curvature depends thus on the point at which the straps 4, 5, 6 or the adjustment means 16, 17 for the toe in are fitted to the sled. By means of the profile the steering of the sled may be eased from what it would be if the curvature of the skis were allowed to press the tips of the skis towards the underlying surface at its full force. On the other hand, the curvature of the skis decreases the friction on hard ice in the latter case.

By moving the weight towards the rear while the rig is being tilted towards the back, as in surfing, the sled can be made to turn into the wind. At the same time the fin turns, flexibly following the underlying surface and making the turn possible. If the sailor were to stand on the right-hand side of the sail while the wind were to hit the sail from the right, the turn into the wind could take place so that the rear foot of the sailor would press the rear section of the sailing base to the left with the counter force from the bow of the rig. When sailing on ice, mainly the subsurface of the ski 7 would prevent the sled from turning against the direction of motion and the fin 12 together with the ski 11 would steer the sled (when the skis 7 and 11 are tilted inwards, this would be prevented by the ski 11). As the example shows, the sharpened edges of the skis would, for nearly all of their length, function as steering and gliding runners, especially as regards the rear section of the ski 7. The fin 12 makes it possible to move the weight to the rear of the sled without the sled quickly turning against the wind due the grip of the rear on the ice giving way, as often happens when sailing with an ordinary skisled. Directional stability is further enhanced by the adjustment means 16 and 17 of the toe in, fitted in the front of the sled defined by the present invention and stretching from the ski 9 to the ski 7 and the ski 11 so that they are separately adjustable. Because of these separate adjustment means supported by the ski 9 it is possible to adjust the toe in very exactly. These adjustment means having a stabilising effect on the steering can be fitted so that they will, by means of a joint, move the pressure effecting the ski 7 from the side to the ski 11 with a converse effect and vice versa. If, for example, the front of the ski 7 were effected by a horizontal pressure from left to right, this force would be transferred to the ski 11 so that its front section would turn horizontally from right to left by means of the joint. This neutralizing effect on the steerability of the front section may be necessary in certain difficult weather conditions. Respectively, it is possible to increase the steerability of the front section for example by connecting the tips of the skis 7 and 11 by means of an arc. If the skis 7 and 11 are tilted inwards, e.g. an adjustable rope connecting the tips of the skis will suffice as the adjustment means of the toe in.

It is to be noted that the turn imagined above took place with the help of longish skis and a fin so that the turn was stable and had the desired radius. An uneven underlying surface does thus not result in the sled being thrust into a steep and sudden turn or sideways against the direction of movement as ordinary skisleds often tend to do especially in difficult weather conditions. CorrespondinglY, a turn away from the wind takes place by the sailor shifting his weight to the front section of the sailing base by pressing his front foot down and forcing the sled to turn from right to left as explained in the previous example. In the snow steering takes place in the same way by using the footstraps 2 and 20 in a way similar to that explained above. When sailing in the snow one must note that the sled is prevented from turning sideways against the direction of movement mainly by both the edge and the upper surface of the ski 7 (in FIG. 2 away from the viewer) and by the subsurface of the ski 11 (away from the viewer) together with the left side of the fin 12 (away from the viewer) as in the previous example.

It is important that the fin 12 gives a directional stability when making a turn. This is enhanced by the way the fin is fitted, which makes it possible for the fin to hold its grip on the ice even though the pressure changes as the sailor shifts his weight forwards and backwards on the sailing base. The grip on the ice of the fin 12 is based on the fact that the rear section of the ski 9 is flexible. The fin 12 does not steer the sled too heavily when the sailor is standing in the center of the sailing base when sailing in a side wind nor when the sailor is standing slightly behind the center of the sailing base when sailing with the wind, because, due to its way of fitting, the fin 12 tends to assume a vertical position as explained above. It should be mentioned that also more than one fin can be used. These auxiliary fins can be secured e.g. to the skis 8 and 10.

Figure 3:
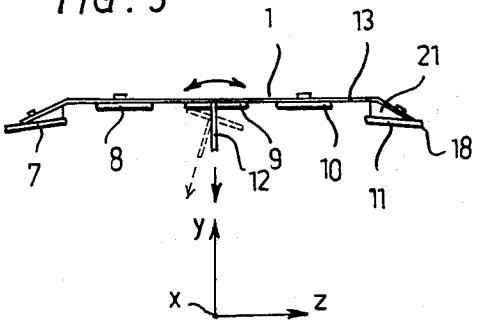
FIG. 3 shows the rear of a sled fitted for sailing in deep snow as seen straight from behind.
Figure 4:
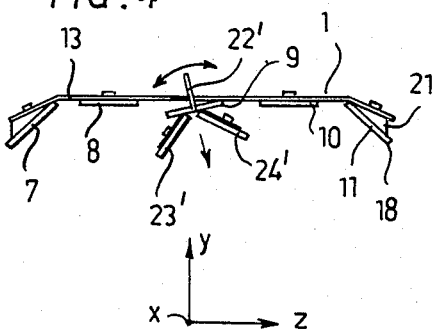
FIG. 4 shows the rear of a sled fitted for sailing on hard ice or snowy ice straight from behind.

The steerability and gliding ability is also enhanced by the fact that the fin 12 can to some extent rotate and tilt with regard to its own longitudinal axis. This is also shown in FIG. 3 and FIG. 4, in which the sled is seen from behind in a somewhat simplified state. In FIG. 3 the ski 9 is fitted with a runner-like and sideways flexible fin 12 described above; in the figure it is shown in two positions. The fin 12 drawn by the continuous line is in its rest position against the underlying surface, whereas the position of the fin drawn by the dotted line allows it to have a more effective grip on the surface of the ice. The fin 12 always tends to assume its rest position. As the fin 12 tilts, its grounding (cf. FIG. 1) makes it curve every time it is pressed by the rear foot of the sailor. Also in this sense the fitting of the fin differs from that described in patent SE 415 467. FIG. 4 shows an alternative fin 22', fitted to the center of the upper surface of the ski 9 and partly tilted to the left. Fitted to the fin 22' are the skis 23' and 24', drawn in a simplified way. In the example they have been fitted to the fin 22' so that, seen from behind, they form the letter A, but it is also possible to fit them so that they form e.g. the letter V (in a way similar to that possible with the skis 7 and 11). The skis 23' and 24' can be fitted to the fin 22' with the help of a joint (not shown in FIG. 4). In FIG. 3 and FIG. 4 the arrows showing the tilting have been drawn. The tilting is based on the twisting of the rear section of the ski 9 or on the way it is fitted and on the fact that the ski 9 is mounted only to the frontmost arcs 14 and 15, wherefore its rear section, starting at the arc 14 can, to some extent, twist around its longitudinal axis or, due to its fitting, tilt somewhat to its side. In FIG. 3 the skis 7 and 11 are shown as fitted for sailing in deep snow. The gliding subsurface of the skis 7, 8, 9, 10, 11 allows sailing in deep snow without the sled sinking into the snow. The position of the skis 7,8,9,10,11 in FIG. 3 also helps prevent the sled from turning sideways against the direction of movement in deep snow, because the upright edges of the skis function as planes preventing that in deep snow. FIG. 4 shows the skis 7 and 11 fitted at a steeper angle with regard to the ice for sailing and hard ice. The adjustment is done by means of the adjustment means 21, 22, 23.

The steerability of the sled is also enhanced by the fact that the tips and the front sections (starting at arc 15) of the skis are flexible. In the solution shown the tips of the skis 8 and 10 are not connected to the skis 7, 9 and 11, and the adjustment means 16 and 17 for the toe in are mounted between the latter ones. Also the skis 7 and 11 can be fitted with straps like the straps 4,5,6 for the adjustment of the curvature (not shown in the figures). The rope 16, 17 connecting the tips of the skis can also function as a strap adjusting the curvature of the skis. Due to the flexible front and the fitting of the skis the apparatus does not tilt to the same degree even if the tip or subsurface of a ski were effected by a raising force caused by an uneven underlying surface. The flexibility of the tips of the skis and the position of the steering means (12) at the rear of the sled for their part aid the movement of the sled with as little friction as possible in deep snow. The adjustment means of the toe in can be constructed so that they allow the outermost skis 7 and 11 freely to bend outwards, but prevent the toe in of these skis to change inwards so that the tips of the skis 7 and 15 would approach each other beyond a certain point. Correspondingly, when the skis 7 and 11 are tilted inwards, these functions are the opposite.

If necessary, the sled is provided with floats (not shown in the figures) by fitting these e.g. between the straps 4,5,6 adjusting the curvature and the front sections of the skis 8,9,10 by tightening the straps. As the floats can be mounted in the front of the sled without detriment to the sailing properties of the sled, this means an improvement compared to the solutions known in which the floats form part of the frame, between the sailor and the sailing plate, which in turn makes the steering more difficult because the sailor is too high above the underlying surface due to the thick frame (cf. SE No. 415 467 and the solution in the "Ice Bird"). The purpose of the straps 4,5,6 is also to protect the rig from being damaged when it is tilted over the front of the sled as well as to protect the sailor if he should inadvertently fall over the front of the sled.

What I claim is:

1. A board-sailing mechanism that comprises:

a plurality of gliding parts to permit travel at the surface of a medium and adapted to prevent the board-sailing mechanism from sinking into the body of the medium, said plurality of gliding parts being mechanically secured to one another to form an elongate but flexible structure having a surface to support a surfer, said gliding parts comprising two longitudinally-directed outermost skis and at least one longitudinally-directed ski intermediate the outermost skis, the skis being bound to one another by flexible means in a way that renders the board-sailing mechanism flexible, the outermost skis being disposed at an angle to the surface of the flexible structure so that one end of each outermost ski engages said medium;

sail means secured to the gliding parts to provide propulsion of the mechanism along the surface of the medium; and fin means secured to the flexible structure and extending longitudinally rearwardly from the flexible structure to engage said medium, the fin means being flexible in a direction that has a component orthogonal to the surface of the flexible structure, said fin means being an elongate spring member that is vertically flexible as well as flexible about its vertical axis, the skis and the fin means serving, in combination, to render the board-sailing mechanism effective in conditions of both ice and snow.

2. A board-sailing mechanism that comprises:

a plurality of gliding parts to permit travel at the surface of a medium and adapted to prevent the board-sailing mechanism from sinking into the body of the medium, said plurality of gliding parts being mechanically secured to one another to form an elongate but flexible structure having a surface to support a surfer, said gliding parts comprising two longitudinally-directed outermost skis and at least one longitudinally-directed ski intermediate the two outermost skis;

sail means secured to the gliding parts to provide propulsion of the mechanism along the surface of the medium; and fin means secured to the flexible structure and extending longitudinally rearwardly from the flexible structure to engage said medium, the fin means being flexible in a direction that has a component orthogonal to the surface of the flexible structure, said fin means comprising a fin secured to the upper surface at the intermediate ski, said pair of longitudinally-directed skis being secured to said fin and being disposed at an angle to said surface of the flexible structure, the pair of longitudinally-directed skis being adapted for tilting to effect steering of the board-sailing mechanism, the longitudinally-directed skis being flexibly interconnected to provide maximum interaction between the subsurface of the board-sailing mechanism and said medium.

3. A board-sailing mechanism according to claim 2 that includes a plurality of arcs at the upper surface of the board-sailing mechanism, which arcs are secured to each of the skis and bind the skis together, one of the arcs being disposed near the rear of the mechanism, said fin being secured to the rearmost arc.

4. A board-sailing mechanism that comprises:

a plurality of gliding parts to permit travel at the surface of a medium and adapted to prevent the board-sailing mechanism from sinking into the body of the medium, said plurality of gliding parts being mechanically secured to one another to form an elongate but flexible structure having a surface to support a surfer, said gliding parts comprising two longitudinally-directed outermost skis and three longitudinally-directed inner skis disposed between the two outermost skis and laterally spaced from one another, the three inner skis forming the surface of the flexible structure which serves as a sailing base;

sail means secured to the gliding parts to provide propulsion of the mechanism along the surface of the medium; and fin means secured to the flexible structure and extending longitudinally rearwardly from the flexible structure to engage said medium, the fin means being flexible in a direction that has a component orthogonal to the surface of the flexible structure, said fin means comprising a fin secured to the center ski of the three inner skis and extending longitudinally rearwardly of said center ski, said fin having a sharpened edge to engage said medium and being adapted to maintain engagement by a combination of flexibility of the fin and flexibility of the center ski, said sailing base having two spaced footstraps to receive the feet of the surfer who stands on the sailing base and grasps the sail means, steering of the board-sailing mechanism being achieved by the surfer shifting his weight relative to the sailing base to deform the board-sailing mechanism and hence transmit controlled steering forces upon the skis and the fin.

5. A board-sailing mechanism as claimed in claim 4 having footstraps at the surface of the flexible structure to receive the feet of a surfer who guides the board-sailing mechanism, at least in part, by forces exerted on the board-sailing mechanism through the footstraps, said fin being able to rotate and tilt with respect to its longitudinal axis.

6. A board-sailing mechanism according to claim 4 that includes a plurality of arcs at the upper surface of the board-sailing mechanism, which arcs are secured to each of the skis and bind the skis together, one of the arcs being disposed near the rear of the mechanism, said fin being secured to the rearmost arc.

* * * * *